US005150900A

United States Patent [19]

Onzo

[11] Patent Number: 5,150,900

[45] Date of Patent: Sep. 29, 1992

[54] HEPTAHEDRON RANDOM CHARACTER SELECTOR

[76] Inventor: Joseph J. Onzo, 1561 Fuchsia Dr., San Jose, Calif. 95125

[21] Appl. No.: 812,139

[22] Filed: Dec. 18, 1991

[51] Int. Cl.[5] ..... A63F 9/04

[52] U.S. Cl. ..... 273/146

[58] Field of Search ..... 273/146, 147

[56] References Cited

U.S. PATENT DOCUMENTS 4,927,158 5/1990 Lierman ..... 273/146

5,031,915 7/1991 Sanditen ..... 273/146

FOREIGN PATENT DOCUMENTS 803600 10/1958 United Kingdom ..... 273/147

*Primary Examiner*—Benjamin H. Layno

*Attorney, Agent, or Firm*—John J. Leavitt

[57] ABSTRACT

Presented is a random character selector device having a heptahedron-shaped body portion displaying seven facets arranged symmetrically about a central longitudinal axis. Seven different sets of indicia related to numerical values from one (1) to seven (7) are marked on or embedded within the heptahedron-shaped body portion so that each numerical value is visible on or through at least one associated facet of the heptahedron body portion. The heptahedron-shaped random character selector is rolled on a flat surface and comes to rest on one of the flat facets. One of the indicia sets is displayed diametrically on the top of the selector device.

13 Claims, 1 Drawing Sheet

HEPTAHEDRON RANDOM CHARACTER SELECTOR

BACKGROUND OF THE INVENTION

1. Field of the Invention

This invention relates to devices for the random selection of numerical indicia or indicia representative of a specific number, and more particularly to a random indicia selector device in the form of an elongated body having a heptahedron configuration in which indicia representative of numbers from one (1) to seven (7) are visible through each of the seven facets of the heptahedron-shaped body.

2. Description of the Prior Art

There are numerous devices of different types that are useful for selecting at random a number, letter or other character. Many of these are of the type in which a hollow container having a platen formed with multiple recesses indicated by indicia also contains a specific number of spherical bodies that randomly arrange themselves in the recesses when the container is shaken. These types of random number selectors are represented by U.S. Pat. Nos. 3,204,345; 3,237,949; 4,465,278; 4,497,486; 4,498,671; and 4,545,578, among others, including the patents cited in the patents noted. Among foreign patents related to these types of random character selectors are French patents 1,480,344 and 2,455,777; and British patent 1,418,690.

Other types of random number or character selectors include the spinner type in which a rotary pointer is spun about a pivot and then permitted to come to rest at a random location marked with indicia of some specific type. Still another type, and perhaps the most widely used and therefore very well known device is the six-sided cube marked with indicia representing the numbers from one to six, and usually used in pairs called "dice" in the game of chance called "craps".

A preliminary patentability and novelty search conducted in connection with the subject matter hereof revealed the existence of the following U.S. Pat. Nos.:

| | |
|---|---|
| 1,527,937 | 1,787,521 |
| 3,603,593 | Des. 263.607 |

Referring to the patents listed above in the order of their issuance, it is noted that U.S. Pat. No. 1,527,937 shows merely a six-sided die of the type used in the game of "dice", but marked with indicia related to the game of baseball.

U.S. Pat. No. 1,787,521 discloses a game that utilizes a pair of six-sided "indicators", the six sides of the "indicators" having different indicia on them related to different colors. The indicia is printed or otherwise marked on each flat surface on the exterior periphery of the "indicators" and when the "indicator" is rolled and comes to rest on a flat surface, the uppermost surface is also flat to expose the indicia marked thereon.

U.S. Pat. No. 3,603,593 discloses an octagonal game device for use in playing a fortunetelling and wagering game based upon the I Ching. Each octagonal dice, of which there are three, has marked on each facet a symbol corresponding to a component of a hexagram that is marked on one of 64 quadrilateral areas marked on a game board. Again it should be noted that the octagonal game piece, having eight sides, always comes to rest on one of the flat facets, with the diametrically opposed facet, i.e., the uppermost facet, also being flat.

Lastly, U.S. Design patent 263,607 discloses a die formed with ten facets defining the outer periphery of the die, with each facet bearing indicia including four circular depressions arranged in a row and in alignment with a longitudinal depression. The various depressions are variously colored for a purpose that is not disclosed. Because the die possesses ten facets, each facet lies diametrically opposed to another flat facet, so that when the die is rolled and comes to rest, a flat facet will always be uppermost.

Experience has taught that many people have difficulty selecting random numbers for use in connection with a game of chance. This process is so difficult for some people that they use various "systems" for selecting a number or a group of numbers. One popular method that is used by many people is to use the ages of their children, or of their parents, or other relatives. Another method is to use the numbers on license plates, while still another method is to select specific positions, such as second from left, or third from right, etc. In every case, the various methods require a decisional process that can frequently be time consuming and traumatic for the person attempting to randomly select one or more numbers.

Accordingly, one of the objects of this invention is to provide a small hand-held device which may easily be utilized to randomly select one or more numbers for a game of chance.

Another object of the invention is the provision of a random character selector device which is relatively inexpensive, attractive, unusual in its configuration and which requires only that it be caused to roll along a flat surface and permitted to come to rest to indicate a number randomly, thus eliminating the sometimes traumatic and time consuming decisional process.

In the game of chance known as "PAI GOW" or "DOUBLE HAND POKER", the game proceeds by the dealer distributing seven sets of seven cards per set, with any one of a number of players, designated the "banker", being designated to select any one of the distributed sets of seven cards for play in the game. The seven sets of cards are customarily indicated as sets 1, 2, 3, 4, 5, 6 and 7, from left to right as viewed from the dealer's side of the table. This selection process involves the time consuming and sometimes traumatic decisional process noted above. Accordingly, a still futher object of the invention is the provision of an attractive, easy to use, device that carries indicia indicating the numbers from one (1) to seven (7) of the sets and which may be used by a player to select the one set of cards to be used in a game of pai gow or double hand poker.

People frequently like to personalize items they carry in their pocket. Accordingly, another object of the invention is the provision of a random number selector device having a body that is transparent and configured in the form of a heptahedron, and arranged so that indicia representing numbers or characters, in addition to personalized indicia, may be enclosed within the body yet be visible through the transparent body.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the random character selector device of the invention comprises an elongated body portion having seven adjoining elongated surfaces of equal length and width, thus forming an elongated body having a heptahedron-shaped outer periphery symmetrical about a central longitudinal axis. The outer periphery of the heptahedron-shaped body is transparent, and on the outer periphery or within the body there are located selected indicia indicative of the numerals "one" through "seven". In a preferred embodiment, the indicia constitute black circular spots embedded within the heptahedron-shaped body portion. A single spot visible through the transparent body indicates the numeral "1" or the equivalent value in any other numerical system, while two spots are representative of the numeral "2" or equivalent value, the indicia progressing successively until seven spots are visible to indicate the numeral "7" or equivalent value. Preferably, the different spots are positioned within the transparent body of the device to be visible through two adjoining facets of the seven-sided outer periphery of the body. In one aspect of the invention, the elongated transparent heptahedron-shaped body is tubular in its configuration, formed with an inner periphery that is also heptahedron-shaped, with the various spots indicative of the numerals from "1" to "7" being positioned on or adjacent to the seven facets forming the inner periphery and visible through the transparent outer periphery of the body. The heptahedron-shaped inner bore is preferably filled with a suitable material to form a solid body having a comfortable "feel" when held in the hand. In a second embodiment, the inner periphery of the heptahedron-shaped body is cylindrical and the spots are marked on or placed adjacent to the cylindrical inner periphery in a position to be visible through the exterior periphery of the transparent body. Again the central bore is suitably filled, and end caps are provided to enhance the appearance of the transparent body and provide the requisite "feel" to the device.

DESCRIPTION OF THE PREFERRED EMBODIMENTS

Figure 1:
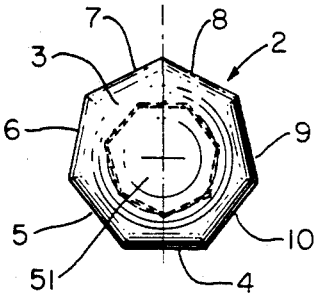
FIG. 1 is an end elevational view of one of the preferred embodiments of the heptahedron-shaped random character selector device of the invention.
Figure 2:
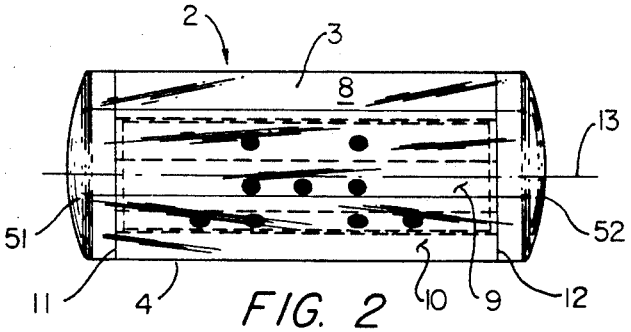
FIG. 2 is a side elevational view of the heptahedron-shaped device illustrated in FIG. 1.

In terms of greater detail, and referring to the drawings and the prior art patents discussed above, it requires only a cursory comparison of the patents listed above with the structure illustrated in the drawings to indicate that the prior art does not disclose or suggest a heptahedron-shaped body having seven separate and distinct surfaces or facets through which are visible specific indicia representative of a number from one (1) to seven (7), with one of such specific indicia being principally and randomly visible each time the heptahedron-shaped body comes to rest after being rolled on a flat surface.

It should be noted and understood that each time the heptahedron-shaped body comes to rest after being rolled, it will rest on one of its seven flat facets, and that diametrically opposite the flat facet on which the heptahedron-shaped body rests there will be positioned an apex between two adjoining flat facets. Stated in other words, because the body is seven-sided, i.e., having a heptahedron outer periphery, a plane including the central axis of the body and passing through the apex between two adjoining facets will bisect the flat facet diametrically opposite the apex through which the plane passes.

Another relationship that is important and should be noted and understood is that each time the heptahedron-shaped body comes to rest on a flat facet, the uppermost surface of the body will be an apex forming the jointure of two adjoining flat facets, and that indicia appropriately positioned within the transparent body will be visible through each of the flat facets on either side of the upper apex.

Referring to the embodiment illustrated in FIGS. 1 through 6 of the drawings, all of the figures of which are shown approximately twice actual size for purposes of clarity, it will there be seen that the heptahedron-shaped device is designated generally by the numeral 2, and constitutes an elongated body 3 approximately $1\frac{3}{4}''$ in length and having an overall diametrical dimension of approximately $\frac{7}{8}''$. Preferably, the main body 3 of the device is formed from an appropriate synthetic resinous material such as that sold under the trademark "Lucite", with an exterior surface that is divided into seven highly polished transparent facets 4, 5, 6, 7, 8, 9 and 10, each of the facets being rectangular in its configuration, with the opposite end edges of the facets being intercepted by end walls 11 and 12 that are also seven-sided.

The outer periphery of the heptahedron-shaped body 3 is symmetrical about a central longitudinal axis 13, and constitutes an elongated tubular member, the inner periphery of which is also symmetrical about the central axis 13, and also formed with seven rectangular sides to form a heptagonal inner periphery. However, it should be noted that the heptagonal inner periphery, while symmetrical about the central axis, is not symmetrical with the seven-sided outer periphery of the body. Thus, as seen in FIG. 1, each apex of the heptagonal inner periphery lies medianly radially opposite one of the flat facets of the outer periphery. This out-of-symmetry arrangement of the inner and outer peripheries is provided for a reason which will hereinafter be explained.

Figure 3:
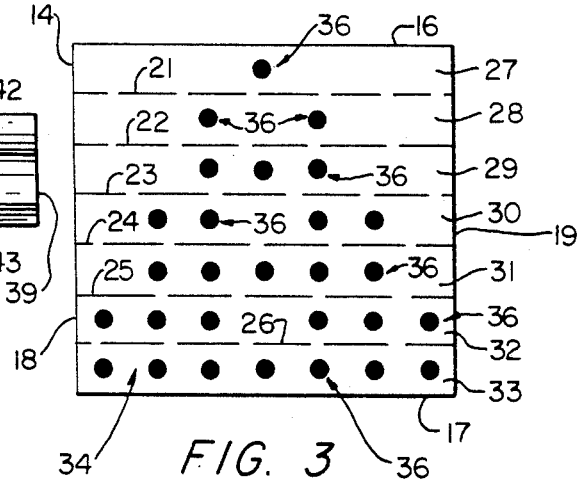
FIG. 3 is a plan view of the formable flat sheet on which are marked indicia of the type visible through the transparent facets of the heptahedron-shaped outer periphery of the device, the formable flat sheet being folded to fit the heptagonal inner periphery of the heptahedron body portion.
Figure 6:
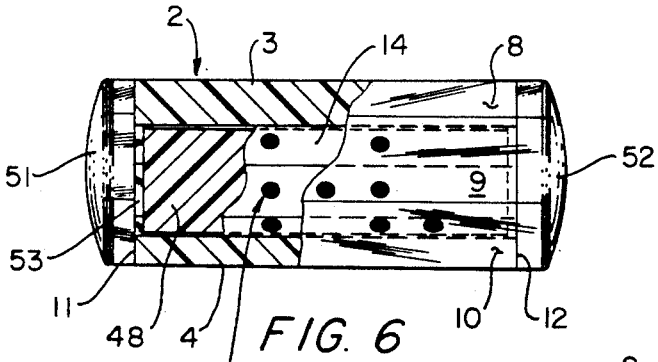
FIG. 6 is an elevational view of the device illustrated in FIG. 1, with portions of the structure broken away to reveal the internal structure and the relationship of the flat sheet of FIG. 3 and the core member of FIG. 5 about which the flat sheet is conformed.

In FIG. 3 there is illustrated a flat sheet designated generally by the numeral 14 and having upper and lower side edges 16 and 17, respectively, intercepted by left and right end edges 18 and 19, respectively, to form a generally rectangular sheet that is scored at regular intervals by six score or fold lines 21, 22, 23, 24, 25, and 26, thus dividing the surface of the rectangular sheet into seven rectangular areas designated by the numerals 27, 28, 29, 30, 31, 32 and 33, as shown. The sheet 14 may of course be fabricated from paper card stock, but preferably it is fabricated from a thin sheet of synthetic resinous material such as that sold under the trademark "Mylar", and is provided with at least one aluminized surface designated generally by the numeral 34 so as to render the sheet opaque to the transmission of light, yet reflective of light rays that impinge upon the aluminized surface.

Marked on the aluminized surface 34, within the confines of each of the rectangular surfaces 27–33 thereon, are indicia designated generally by the numeral 36. As shown in FIG. 3, the indicia constitute circular spots printed or otherwise marked on the sheet, with a single spot being centrally positioned in the rectangular area 27 adjacent the upper edge 16, while seven spots are marked in the rectangular area 33 adjacent the lower edge 17. Between these two rectangular areas, the remaining rectangular areas are also marked with indicia, but with a different number of circular spots to indicate different numerical values. Thus, the rectangular area 28 is marked with two circular spots, while the area 29 is marked with three spots. In like manner, the area 30 is marked with four spots, but note that these four spots are arranged in pairs of two spots each. The reason for this is that it is advantageous if the number of spots can be determined at a glance, and it is easier to visualize the numeral "4" when the spots are arranged in pairs of two spots each, with the pairs separated longitudinally along the rectangular area as shown.

Rectangular area 31 is marked with five circular spots, and the spots are all aligned and equally spaced along the longitudinal centerline of the rectangular area as shown. In like manner, referring to the rectangular area 32, here six spots are marked, representative of the numeral "6", but the spots are arranged in two pairs spaced apart and each containing three spots, to thus facilitate recognition of these spots as representing a value of "6".

The rectangular sheet 14 is dimensioned carefully so that its length measured between the end edges 18 and 19 is just short of the length of the body 3 as measured between the ends 11 and 12, by about 1/16". The sheet 14, properly marked as shown, is of course intended to be folded along the fold lines 21–26 so as to bring the upper edge 16 into contact with the lower edge 17, and with the fold lines between these two edges forming the sheet into a tubular member having an interior and exterior configuration that is heptagonal. The heptagonally formed tubular sheet member is dimensioned to fit snugly within the interior heptagonal periphery of the body 3, conforming closely thereto so that the aluminized surfaces of the indicia-bearing elongated rectangular areas of the sheet fit contiguously against the inner polished surfaces of the interior heptagonal periphery. When so position, the indicia on the sheet are clearly visible through the outer transparent heptagonal periphery of the body 3, with the flat rectangular surfaces of the sheet 14 lying medianly radially opposite an apex of the outer periphery of the body, as shown in FIG. 1.

Figure 4:
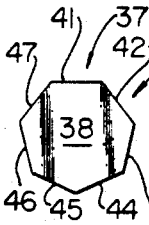
FIG. 4 is an end elevational view of a heptahedron-shaped core member adapted for insertion in the heptagonal inner periphery of the device after insertion of the folded flat sheet of FIG. 3 within the inner periphery.
Figure 5:
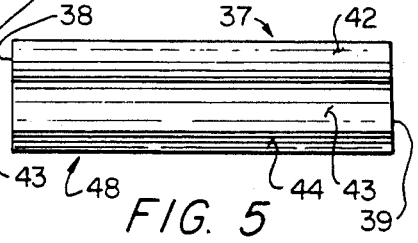
FIG. 5 is a side elevational view of the heptahedron-shaped core member illustrated in FIG. 4.

To support the heptagonal-formed sheet 14 in this position within the interior periphery of the body 3, there is provided a core member designated generally by the numeral 37, as illustrated in FIGS. 4 and 5. As there shown, the core member is elongated, having opposite ends 38 and 39 intercepting seven flat elongated rectangular facets 41, 42, 43, 44, 45, 46 and 47 defining a heptahedron body 48. The length of the heptahedron body 48 exactly matches the length of the sheet 14 measured between the edges 18 and 19, so that when the core member is inserted into the interior of the heptagonal sheet 14, the inner periphery of the heptagonally-shaped now tubular sheet 14 exactly matches the exterior periphery of the core member. The aluminized surface 34 of the sheet 14, even though now folded and formed into a heptagonally-shaped tube, is intimately and conformably pressed against the heptagonally-shaped inner periphery of the body 3.

As stated above, the sheet 14 is dimensioned between the edges 18 and 19 to be about 1/16" shorter than the body 3 measured between its end surfaces 11 and 12, but is exactly the same length as the core member 37. Thus, when the heptagonally-formed sheet 14 and the core member 37 are inserted snugly into the interior periphery of the body 3, and centered longitudinally therein, there is left at each end a clearance gap of about 1/32" between the associated ends of the body 3 and the associated ends of the core member 37. This clearance gap is utilized to orient and retain on the opposite ends of the body 3, appropriate end caps 51 and 52 (FIGS. 1 and 2), domed as shown, and each provided with an orienting pad 53 projecting from the inner face of each end cap an amount sufficient to fill the clearance gap and abut the end of the core member 37 and the edges 18 and 19 of the heptagonally-formed sheet 14 within the body 3.

It should be noted that the orienting pad 53 is configured to have a heptagonally-shaped outer periphery to fit the heptagonally-shaped inner periphery of the body 3. The synthetic resinous end caps are suitably secured to the end faces 11 and 12 of the body 3, and to the end faces 38 and 39 of the synthetic resinous core member by a suitable adhesive (not shown) that is compatible to the synthetic resinous materials used. To provide a comfortable "feel" to the device, the edges of the domed end caps are rounded, smoothed and polished, as shown.

While I have described the heptagonally-shaped tubular sheet as initially inserted conformably into the interior periphery of the body 3, with subsequent insertion of the core member 37, it should be understood that the aluminized and indicia-marked sheet 14 may, alternatively, be wrapped about the core member and this sub-assembly then inserted into the interior periphery of the body 3. Where appropriate, the aluminized sheet 14, may be conformably wrapped about the core member and adhesively secured thereto prior to insertion into the interior periphery of the body 3. Still another method of assembly is to conform the heptagonally-shaped sheet 14 to the interior heptagonally-shaped periphery of the body 3, and then to pour an appropriate casting resin into the interior of the conformed heptagonally-shaped sheet 14, thus pressing intimately against the sheet and filling the void therein. Thereafter, the end caps are applied as before.

Figure 7:
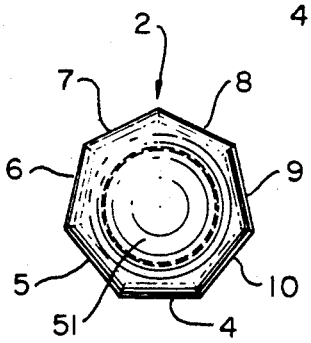
FIG. 7 is an end elevational view of a second preferred embodiment of the heptahedron-shaped random character selector device.
Figure 8:
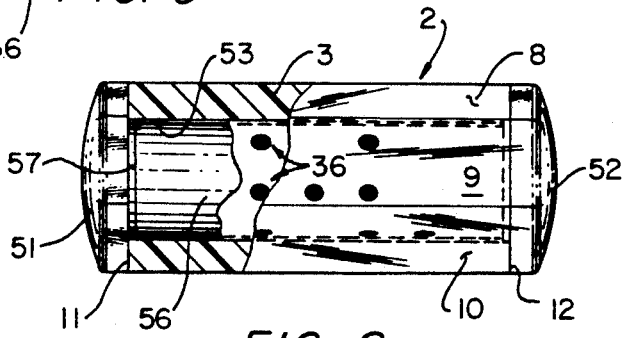
FIG. 8 is a side elevational view of the heptahedron-shaped device of FIG. 7, with portions of the structure broken away to reveal the internal construction.

Referring now to the embodiment of the invention illustrated in FIGS. 7 and 8, it will there be seen that the heptahedron random character selector device is substantially similar to the embodiment illustrated in FIGS. 1-6, and the same reference numbers as applied in FIGS. 1-6, have been applied to identical elements of this embodiment. The primary difference between the two embodiments is that the inner periphery 55 of the body 3 in FIGS. 7 and 8 is cylindrical in its cross-section, rather than heptagonal, and the core member 56 in the embodiment illustrated in FIGS. 7 and 8 is cylindrical in its cross-sectional configuration rather than formed as an elongated heptahedron. This enables the elimination of the score or fold lines 21-26 on the aluminized sheet 14, thus reducing the cost of manufacture somewhat, but requiring careful placement of the sheet 14, now wrapped cylindrically about the core member 56, so that the indicia marked on the sheet 14 are appropriately visible radially opposite each apex of the heptagonally-shaped outer periphery of the body 3. Also simplified is the configuration of the orientation pad 57, which in this instance need merely be cylindrical to fit snugly within the cylindrical inner periphery of the body 3 at each opposite end thereof.

In use, when a "banker" is selected to choose the one set of distributed cards for the game of pai gow or double hand poker, the banker rolls the heptahedron-shaped random character selector along the smooth tabletop, usually covered with felt, and selects the hand-set corresponding to the indicia indicated at the top of the transparent random character selector through which the indicia embedded therewithin are visible from the exterior of the heptagonal body.

Having thus described the invention, what is believed to be new and novel and sought to be protected by letters patent of the United States is as follows.

I claim:

1. A random character selector, comprising a heptahedron body portion having an outer heptagonal periphery symmetrical about a central longitudinal axis and including seven facets, and indicia associated with each separate facet and visible on the outer periphery of the heptahedron body portion;

(a) said heptahedron body portion being formed with transparent outer and inner peripheries, and a plurality of sets of different indicia are spaced around the inner periphery of the heptahedron body portion and visible on the outer periphery thereof;

(b) said plurality of sets of different indicia being displayed on a thin flexible sheet, and said sheet is conformed to the inner periphery of said heptahedron body portion whereby said different sets of indicia are visible through the outer periphery of the heptahedron body portion; and (c) and a core member provided within the conformed flexible sheet to retain the sheet intimately conformed to said inner periphery of the heptahedron body portion.

2. The random character selector according to claim 1, wherein said heptahedron body portion is transparent, and said indicia are embedded within the transparent heptahedron body portion and visible through its outer heptagonal periphery.

3. The random character selector according to claim 1, wherein said heptahedron body portion is formed with an inner heptagonal periphery which includes seven facets.

4. The random character selector according to claim 1, wherein seven different indicia correlated in value from one to seven are associated with said separate facets and visible on the outer periphery of the heptahedron body portion.

5. The random number selector according to claim 1, wherein said inner periphery is heptagonal.

6. The random character selector according to claim 5, wherein said heptagonal inner periphery is symmetrical about said central longitudinal axis and asymmetrical with respect to the heptagonal outer periphery of the heptahedron body portion.

7. The random number selector according to claim 1, wherein said inner periphery is cylindrical.

8. The random character selector according to claim 1, wherein end caps are secured to opposite ends of the heptahedron body portion.

9. The random character selector according to claim 1, wherein said inner periphery of the heptahedron body portion is heptagonal, and said core member possesses a heptagonal outer periphery to retain the thin flexible sheet on which said indicia are displayed intimately conformed to the heptagonal inner periphery of the heptahedron body portion.

10. The random character selector according to claim 1, wherein said inner periphery of the heptahedron body portion is cylindrical, and said core member possesses a cylindrical outer periphery to retain the thin flexible sheet on which said indicia are displayed intimately conformed to the cylindrical inner periphery of the heptahedron body portion.

11. The random character selector according to claim 1, wherein said thin flexible sheet is opaque to the passage of light therethrough.

12. The random character selector according to claim 11, wherein said indicia are marked on one side of said thin flexible sheet, and the side of said sheet on which said indicia are marked is reflective to light impinging thereon whereby said indicia are visible through the outer periphery of said heptahedron body portion.

13. A random character selector, comprising a heptahedron body portion having an outer heptagonal periphery symmetrical about a central longitudinal axis and including seven facets, and indicia associated with each separate facet and visible on the outer periphery of the heptahedron body portion;

(a) said heptahedron body portion being formed with transparent outer and inner peripheries, and a plurality of sets of different indicia are spaced around the inner periphery of the heptahedron body portion and visible on the outer periphery thereof;

(b) said inner periphery being heptagonal; and (c) said heptagonal inner periphery is symmetrical about said central longitudinal axis and symmetrical with respect to the heptagonal outer periphery of the heptahedron body portion.

* * * * *